US008127699B2

(12) United States Patent
Hicks et al.

(10) Patent No.: US 8,127,699 B2
(45) Date of Patent: Mar. 6, 2012

(54) MONITORING APPARATUS

(75) Inventors: Brian Hicks, Greenville, SC (US); Jonas Hansson, Osby (SE); Johan Östman, Härnösand (SE)

(73) Assignee: Eltex of Sweden AB, Osby (SE)

( * ) Notice: Subject to any disclaimer, the term of this patent is extended or adjusted under 35 U.S.C. 154(b) by 293 days.

(21) Appl. No.: 12/385,451

(22) Filed: Apr. 8, 2009

(65) Prior Publication Data

US 2009/0260402 A1 Oct. 22, 2009

(30) Foreign Application Priority Data

Apr. 17, 2008 (SE) ..... 0800887

(51) Int. Cl.
*D05C 15/16* (2006.01)

(52) U.S. Cl. ..... 112/270

(58) Field of Classification Search ..... 112/470.01, 112/278, 273, 475.02
See application file for complete search history.

(56) References Cited

U.S. PATENT DOCUMENTS 1,980,294 A * 11/1934 Ross et al. ..... 112/273
RE27,165 E * 8/1971 Spanel et al. ..... 112/80.07
4,109,594 A * 8/1978 Spanel et al. ..... 112/80.07
4,538,536 A * 9/1985 Sick ..... 112/273
4,625,666 A * 12/1986 Sick ..... 112/273
4,691,647 A * 9/1987 von Stein ..... 112/80.18
4,841,890 A * 6/1989 Tancs ..... 112/273
7,038,779 B2 * 5/2006 Demarest et al. ..... 356/430
7,204,137 B1 * 4/2007 Skalchunes ..... 73/159

* cited by examiner

*Primary Examiner* — Larry Worrell, Jr.

(74) *Attorney, Agent, or Firm* — McGinn IP Law Group, PLLC

(57) ABSTRACT

The present invention relates to an apparatus for monitoring the yarn or yarns in a carpet making machine or the like, a so-called tufting machine, in which the yarn or yarns are applied on a bed material, e.g. a bed weft, during movement of the yarn or yarns from a yarn magazine, e.g. a creel with a number of yarn bobbins (B) on a number of posts (S) in one or more storeys, to the bed material each through its transparent or translucent tube (R), e.g. a hose, at least one light emitter (4) and one light receiver (6) being positioned at each tube (R) for yarn which is to be in motion and to be monitored, and the light receivers (6) are rehearsed to convert received light into an electric signal which is connected to an electronic circuit for triggering an alarm and possible stoppage of the machine when the electric signal indicates that the yarn in its tube (R) is not in motion.

17 Claims, 4 Drawing Sheets

MONITORING APPARATUS

Figure 1:
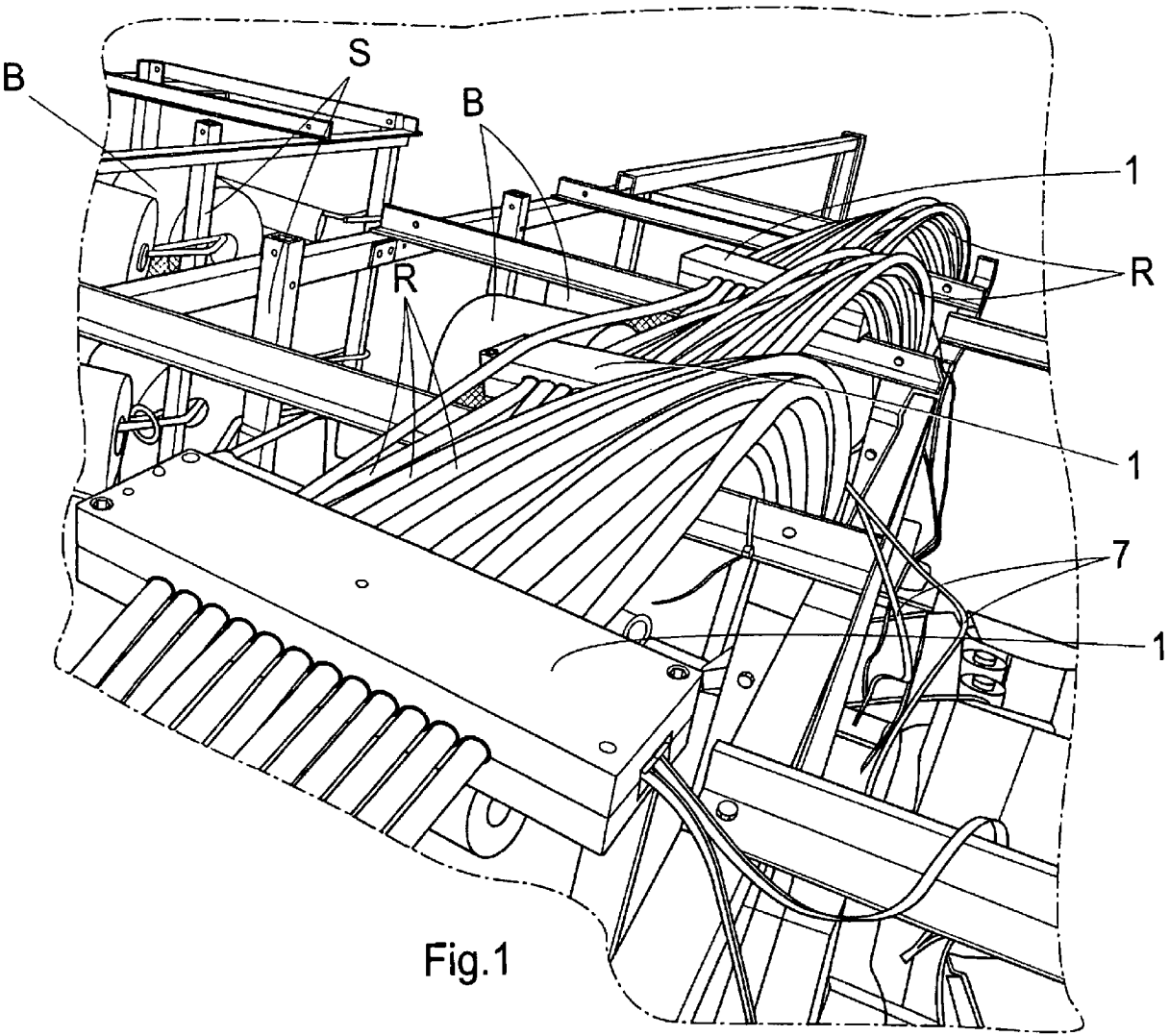

The present invention relates to an apparatus for monitoring the yarn or yarns in a machine for carpet making or the like, a so-called tufting machine, in which the yarn or the yarns are applied on a bed material, e.g. a bed weft, during movement of the yarn or yarns from a yarn magazine, for example a creel, with a number of yarn bobbins (B) on a number of posts (S) in one or more storeys, to the bed material each through an at least partly transparent or translucent tube (R), e.g. a hose.

In the operation of so-called tufting machines, operational stoppages often occur because of problems with the yarn in the form of stoppage or breakage. The stoppage may be because the unwinding of the yarn from its spool or bobbin results in eyes or knots or the like, which prevent drawing of the yarn through the tube or the hose to the bed material, which results in a motion breakage. A fault may occur in the bobbins or the spools in that the yarn turns become fastened in one another, or that winding up of the yarn on different bobbins results in stoppage of the yarn movement. It is of the greatest importance that attention be drawn to such faults, so that the absence of a yarn does not result in an error or defect in the finished carpet and thereby a considerable deterioration in quality, without the operating staff being made aware of the situation in order to stop the machine and carry out suitable remedial measures.

There are such tufting machines in the art that are provided with means for stopping the machine if the tension in any of the numerous yarns drawn into the machine deviates from a predetermined value. After a machine stoppage because of a yarn stoppage or the like, the machine operator must locate the defective yarn, which could result in long machine down times, since many machines operate with several hundred yarn types. This problem naturally becomes particularly serious as regards large machines with as many as a thousand and more yarns that are drawn in simultaneously. The wider the carpets that are to be produced, the greater will be the number of yarns that are moving simultaneously. The greater the number of yarns, the more difficult and time-consuming it becomes for the operators to find the yarn that has stopped moving. There is thus a major need in the art for aids in locating the defective yarn or yarns.

The object forming the basis of the present invention is to satisfy the above-outlined needs in the apparatus disclosed by way of introduction.

This task is solved according to the present invention in the apparatus intimated by way of introduction in that the apparatus for monitoring the yarn or yarns in a machine for carpet making or the like, a so-called tufting machine, in which the yarn or yarns are applied on a bed material, e.g. a bed weft, during movement of the yarn or yarns from a yarn magazine, e.g. a creel, with a number of yarn bobbins on a number of posts in one or more storeys, to the bed material each through its at least partly transparent or translucent tube, e.g. a hose, at least one light emitter and one light receiver being positioned at each tube for yarn which is to be in motion and be monitored, and the light receivers being rehearsed to convert received light into an electric signal which is coupled to an electronic circuit for triggering an alarm and a possible stopping of the machine when the electric signal indicates that the yarn in its tube is not in motion. The light emitter and the light receiver are positioned substantially on either side of each tube (R) for yarn which is to be in motion. Each tube has two light emitters and two light receivers, which are positioned on the outside of the tube substantially in register with one another so that a major portion of the tube is illuminated and thereby monitored. The light emitters are disposed in a part of a bracket through which the tubes extend, the light receiver being disposed in another part of the bracket. The bracket is disposed for a plurality of tubes extending in side-by-side relationship and is divided into an emitter portion and a receiver portion, the transmitter portion having two light emitters for each tube, the receiver portion having two light receivers for each tube, and the tubes with associated light emitters and light receivers being screened-off from one another. The light emitters in the bracket portion are connected in series, while the light receivers for each tube are connected in parallel and coupled to an electronic circuit for evaluating the signal from the light receivers for triggering or activating an alarm or on stoppage of the machine when a threshold value is exceeded. The electronic circuits are interconnected with one another to a host monitoring unit for establishing which of the light receivers is to be monitored and thereby are allocated those tubes in which yarn is to be in motion during a desired period of time. The monitoring unit includes a display screen and means for supplying the desired establishment configuration to the processors of the different apparatuses for selecting those light receivers that are to emit a signal, and display of information regarding the reason for an alarm and any possible machine stoppage. The light emitters and light receivers are of the IR type. The light emitter and light receiver at one tube are screened-off from the light emitter and light receiver at other tubes.

As a result of the present invention, it is possible to realise an apparatus which to a high degree reduces down times in the machines, in that the machine operator can very quickly locate a defective yarn and carry out suitable remedial measures. Moreover, an apparatus according to the present invention is further extremely well-suited for retro-fitting to existing machines without any major intervention in and modification thereof. An apparatus according to the present invention has moreover proved to be so rapid that the machine has time to stop before the yarn breaks, whereby it is possible very rapidly to eliminate a fault and thereby further reduce down time.

Figure 2:
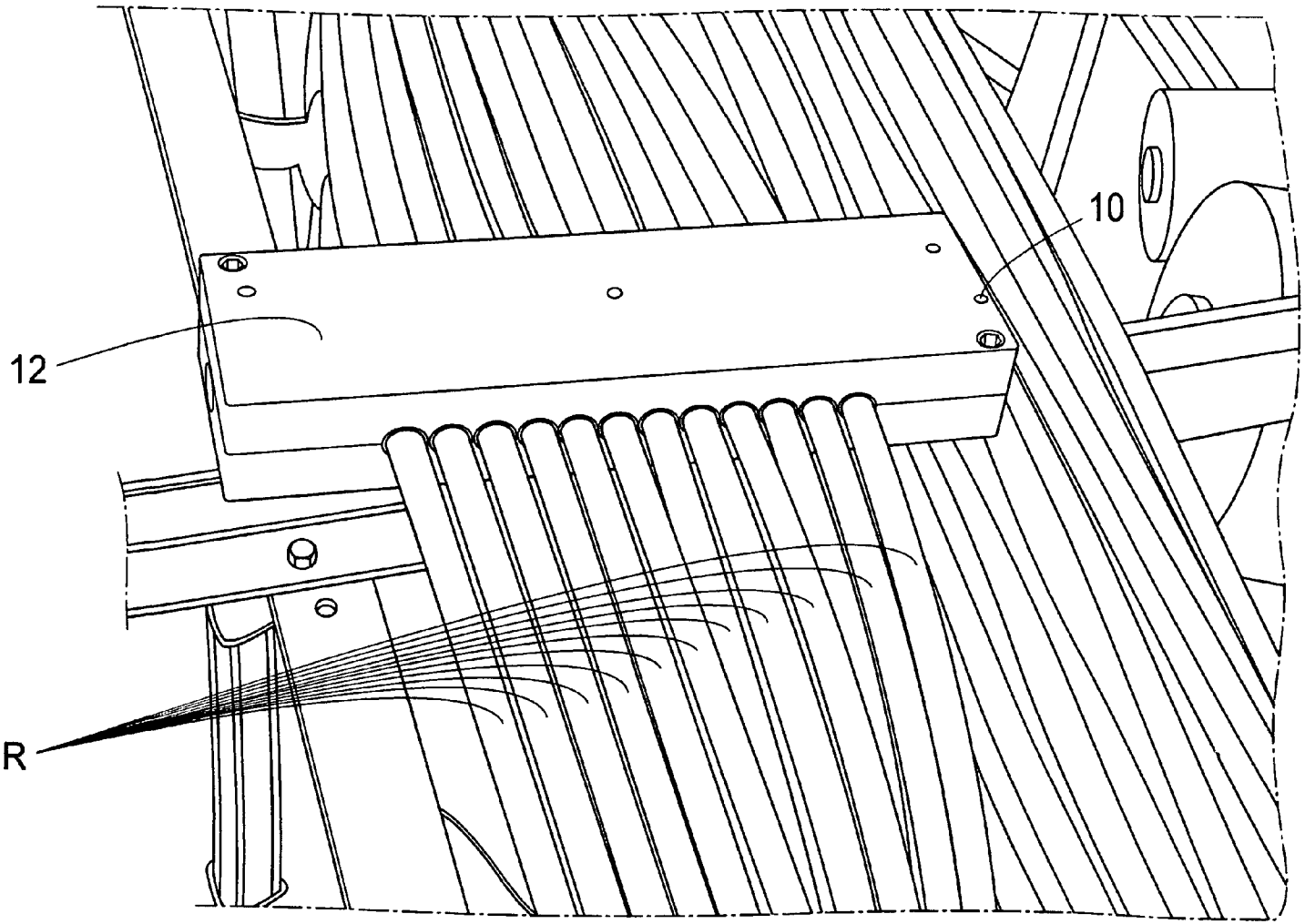
Figure 3:
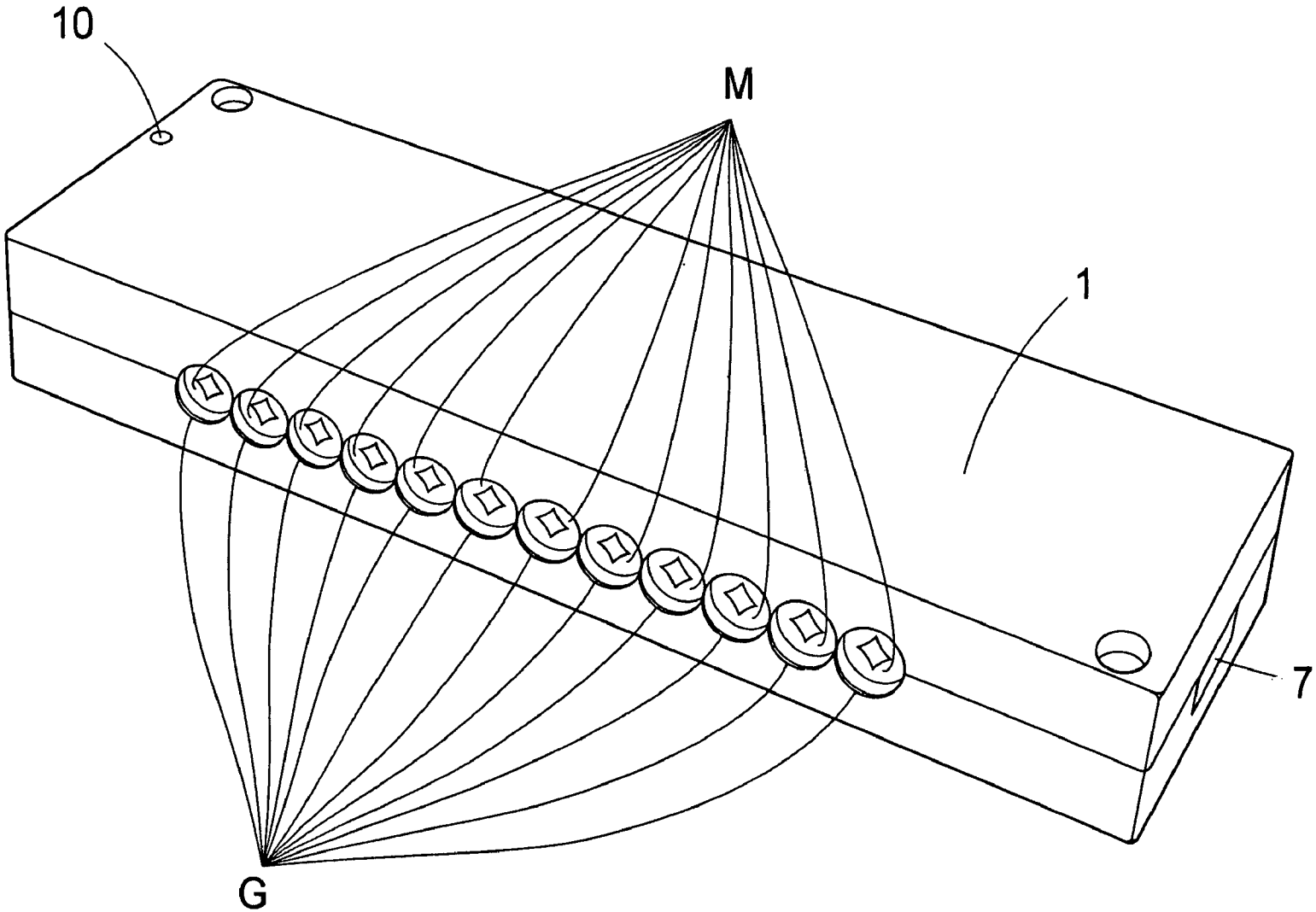
Figure 4:
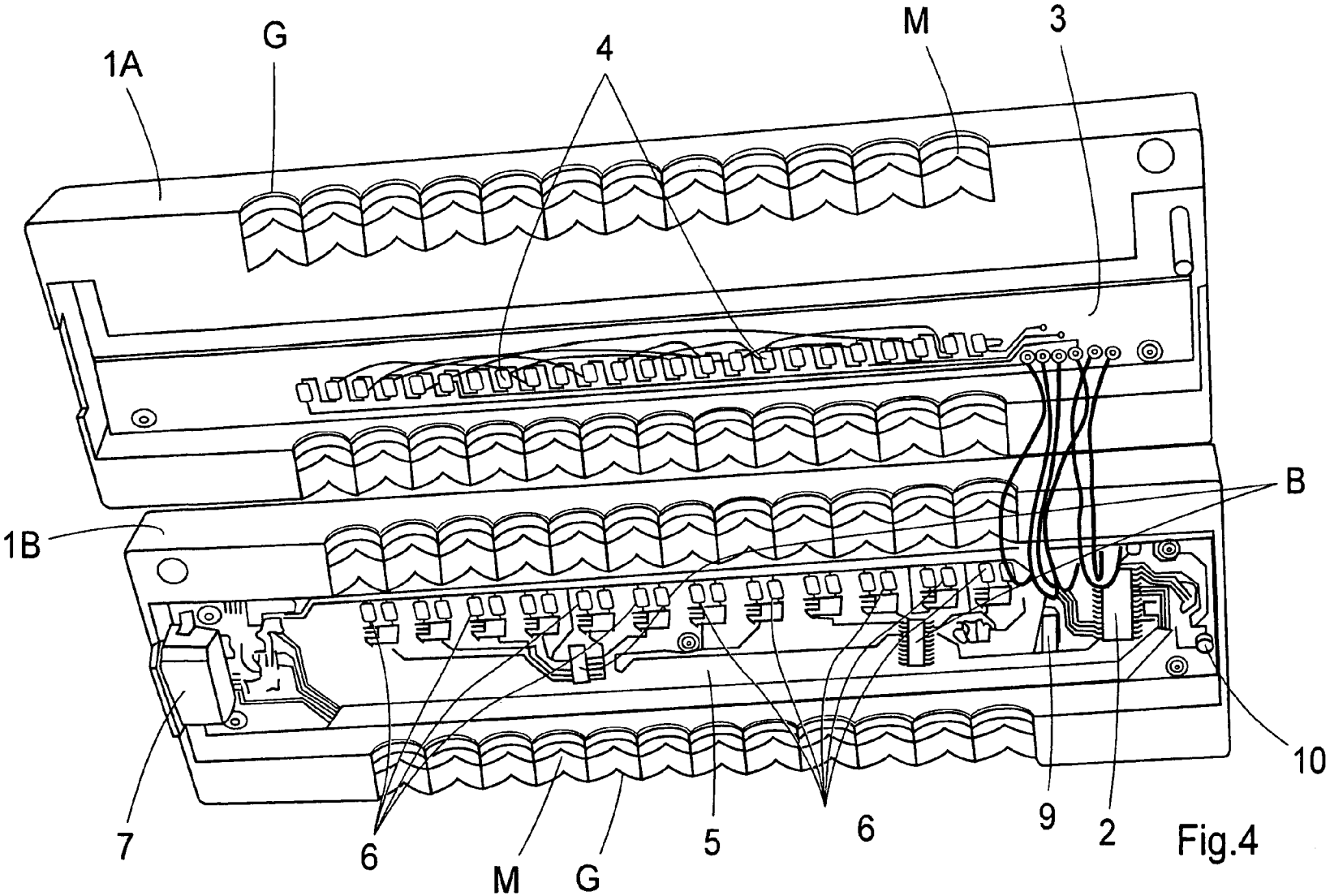

The present invention will now be described in greater detail hereinbelow, with reference to the accompanying drawings. FIG. 1 is a photographic image of a part of a so-called creel in a machine of the tufting type, with a number of apparatuses of one embodiment of the present invention. FIG. 2 is a photographic image of one of the apparatuses according to the present invention in FIG. 1 on a slightly larger scale than in FIG. 1. FIG. 3 is a photographic image of an apparatus according to the present invention of substantially the same type as in FIG. 2, but on a slightly larger scale. FIG. 4 is a photographic image of the apparatus according to the present invention illustrated in FIG. 3, opened in two halves.

An apparatus according to the present invention is particularly well suited for use in a machine for carpet making of the so-called tufting type and will be described in greater detail hereinbelow with reference to such a machine.

In FIG. 1, there is shown a part of the machine, namely a part of a yarn magazine, a so-called creel, which may be approximately 15 meters long and display 17 posts S with six bobbins or yarn spools B on each post S in five rows and possibly in two storeys or levels in a prior art tufting machine. Thus, one such creel or one such thread or yarn magazine delivers a good one thousand threads which may be in motion simultaneously and which are to be monitored. From the thread spools B on the different posts S, the threads or the yarns are each drawn through, as a rule, one tube R. Advantageously, the tubes R are circular, flexible and light-walled, manufactured from a suitable plastic, e.g. pvc. The tubes R are at least partly translucent. The tubes R may also be designated hoses and are disposed in clutches or groups from the posts S right up to the machine proper, where the yarns or the threads are each to be fed up to a needle for stitching the yarn or the yarns into a bed material, e.g. a bed weft. Tufting machines of the above-mentioned type are well-known to a person skilled in the art and will not be described in greater detail here.

In the machine described in this specification and show on the drawings, as will be apparent from FIGS. 1 and 2 each cluster of tubes or hoses R comprises twelve in number and each tube cluster is provided with a monitoring apparatus 1 according to the present invention. Thus, there are twelve tubes which extend through each monitoring apparatus.

As was mentioned above, the tubes or the hoses R are manufactured from a transparent or translucent material, but if such were not to be the case, it is naturally possible to make a joint insert section with a hose section of a translucent material. Such a joint insert may possibly include the apparatus 1 according to the present invention, in which event the joint insert device may consist of the apparatus 1 proper according to the present invention.

All of the monitoring apparatuses 1 are interconnected, by means of leads or conductors T, to one another and to a host monitoring unit or a machine operator terminal (not shown) which is previously known in the art. The host monitoring unit is rehearsed int.al. to cause or set a processor 2 in each monitoring apparatus 1 to select those light receivers 6 which are to emit signals and which thereby are to sense if a thread or a yarn should be in motion during a preferred period of time. This also implies that the processor 2 is rehearsed to pass on the signal from the monitoring apparatus 1 back to the host monitoring unit for evaluation thereof. It has proved to be possible with a high degree of accuracy to distinguish between a signal from the light receivers 6 with a thread or a yarn in motion and a signal from the light receiver 6 with a stationary thread or no thread at all. It is conceivable to position the light emitter 4 on the same side as the light receiver 6, which then receives light reflected from the yarn.

FIGS. 2 and 3 show a monitoring apparatus 1 according to the present invention and it will be apparent that the apparatus 1 has twelve tube or hose passages G. Screening material M is disposed in both the input and output to and from the apparatus 1 and possibly also on either side of the through-going tube or the through-going hose so as to avoid disturbance. The apparatus 1 is operational without screening, but disturbances are avoided and the signals will be clearer and more unambiguous if screening is employed.

FIG. 4 shows the apparatus according to the present invention opened into two halves 1*a* and 1*b*. In the half 1*a*, there is disposed a circuit card plate 3 which carries 24 IR LEDs 4, which implies two for each tube or hose R, or tube or hose passage. Each pair of IR LEDs 4 is as it were each intended for a tube R or hose or passage.

The other apparatus half 1*b* is provided with a circuit card plate 5 which carries 24 IR light receivers 6 which, after closing of the halves 1*a* and 1*b* and thereby closing of the apparatus 1, will be placed in register each with an IR LED 4 with a through-going tube R or a through-going hose between them. The circuit card 5 further supports modular contacts 7 for the leads or conductors T for interconnection with other monitoring apparatuses 1 and the host monitoring unit or the so-called machine operator terminal. The circuit card 5 further supports two components 8 which make for shifting between the different channels or pairs of light receivers 6. A pair of LEDs 4 and a pair of light receivers 6 located substantially in register with one another form one channel. A crystal 9 is disposed to control or clock the processor 2 and a LED 10 is rehearsed to be lit or flash in the event of a thread or yarn stoppage in any of the tubes R or hoses passing through the apparatus. Both named and unnamed components on the circuit cards 3 and 5 and their interconnections are well-known to a person skilled in the art and would therefore not appear to warrant any detailed description.

Thus, the staff or the machine operator will rapidly be able to locate that monitoring apparatus 1 which displays a lit or flashing LED 10, which is visible from the outside of the monitoring apparatus 1. The host monitoring unit or the machine operator terminal unit may also be rehearsed to display in a suitable manner information as to that monitoring apparatus or apparatuses 1 which lack thread or yarn movement.

In such instance, it should be emphasised that the apparatus according to the present invention described in the foregoing is a pure prototype and may be modified to a considerable extent even though the inventive concept proper will remain the same.

Many modifications of the embodiment described in the foregoing are naturally possible without departing from the scope of the inventive concept as defined in the appended claims.

The invention claimed is:

1. An apparatus for monitoring yarn in a machine for manufacturing carpets, in which the yarn passes through an at least partly transparent or translucent tube, the apparatus comprising:

a light emitter and a light receiver, wherein the light emitter and the light receiver are positioned at the tube in which the yarn is to be in motion and be monitored, wherein the light receiver is set to convert received light into an electric signal which is connected to an electronic circuit for triggering an alarm when the electric signal indicates that the yarn in the tube is not in motion, and wherein the light emitter and the light receiver are positioned substantially on either side of the tube in which the yarn is to be in motion.

2. An apparatus for monitoring yarn or yarns in a machine for manufacturing carpets, in which the yarn or the yarns each pass through an least partly transparent or translucent tube, the apparatus comprising:

a plurality of light emitters and a plurality of light receivers, wherein the at least one light emitter and the at least one light receiver are positioned at each tube for yarn in which the yarn is to be in motion and be monitored, wherein the light receivers are set to convert received light into an electric signal which is connected to an electronic circuit for triggering an alarm when the electric signal indicates that the yarn in its tube is not in motion, and wherein each tube includes two light emitters and two light receivers which are positioned on the outside of each tube substantially in register with one another so that a substantial portion of the tube is illuminated and thereby monitored.

3. The apparatus as claimed in claim 2, wherein a light emitter of the plurality of light emitters and a light receiver of the plurality of light receivers are positioned substantially on either side of each tube for yarn which is to be in motion.

4. The apparatus as claimed in claim 3, wherein the light emitters are disposed in a part of a bracket, through which the tubes extend, and a light receiver of the plurality of light receivers is disposed in another part of the bracket.

5. The apparatus as claimed in claim 4, wherein the bracket is disposed for a plurality of tubes extending in side-by-side relationship, and is divided into a transmitter part and a receiver part, the transmitter part includes two light emitters for each tube and the receiver part includes two light receivers for each tub, and wherein the tubes with associated light emitters and light receivers are screened off from one another.

6. The apparatus as claimed in claim 5, wherein the light emitters in the bracket are connected in series, and the light receivers for each tube are connected to an electronic circuit for evaluating the signal from the light receivers for triggering or activating an alarm or a stoppage of the machine when a threshold value is exceeded.

7. The apparatus as claimed in claim 6, wherein the electronic circuits are interconnected with one another to a host monitoring unit for establishing those light receivers which are to be monitored and thereby are allocated to those tubes in which yarn is to be in motion during a desired period of time.

8. The apparatus as claimed in claim 7, wherein the host monitoring unit includes a display screen and means for supplying the desired establishment configuration to the processors of the different apparatuses for selection of those light receivers which are to emit a signal, and display of information as to the reason for an alarm and possible machine stoppage.

9. The apparatus as claimed in claim 1, wherein the light emitter comprises an infrared (IR) type light emitter and the light receiver comprises an IR type light receiver.

10. The apparatus as claimed in claim 1, wherein the light emitter and the light receiver at one tube are screened-off from the light emitter and the light receiver at other tubes.

11. The apparatus as claimed in claim 1, wherein the electronic circuit stops the machine if the electric signal indicates that the yarn in the tube is not in motion.

12. The apparatus as claimed in claim 3, wherein the electronic circuit stops the machine if the electric signal indicates that the yarn in the tube is not in motion.

13. The apparatus as claimed in claim 1, wherein the tube includes two light emitters and two light receivers which are positioned on the outside of the tube substantially in register with one another so that a substantial portion of the tube is illuminated and thereby monitored.

14. The apparatus as claimed in claim 1, wherein the light receiver is set to differentiate if the yarn in the tube is not in motion or if the yarn in the tube is in motion.

15. The apparatus as claimed in claim 1, wherein the light receiver is disposed so as to detect the yarn at a point in the tube.

16. The apparatus as claimed in claim 1, wherein the light receiver is disposed so as to detect the yarn at a transparent or translucent point in the tube.

17. The apparatus as claimed in claim 1, wherein the yarn comprises a plurality of yarns and the tube comprises a plurality of tubes, and wherein each of the plurality of yarns passes through a tube of the plurality of tubes.

* * * * *